US010893731B2

(12) United States Patent
Wingerter et al.

(10) Patent No.: US 10,893,731 B2
(45) Date of Patent: Jan. 19, 2021

(54) CARD HOLDER FOR CREDIT CARDS AND OTHER CARDS

(71) Applicants: Thomas Wingerter, Hamburg (DE); Katrin Mengel, Hamburg (DE)

(72) Inventors: Thomas Wingerter, Hamburg (DE); Katrin Mengel, Hamburg (DE)

( * ) Notice: Subject to any disclaimer, the term of this patent is extended or adjusted under 35 U.S.C. 154(b) by 180 days.

(21) Appl. No.: 15/948,039

(22) Filed: Apr. 9, 2018

(65) Prior Publication Data

US 2018/0310681 A1 Nov. 1, 2018

(30) Foreign Application Priority Data

Apr. 28, 2017 (EP) ..... 17168654

(51) Int. Cl.
*A45C 11/18* (2006.01)
*B42F 17/32* (2006.01)
*B42F 17/30* (2006.01)

(52) U.S. Cl.
CPC ..... *A45C 11/182* (2013.01); *B42F 17/32* (2013.01); *B42F 17/30* (2013.01)

(58) Field of Classification Search
CPC ..... A45C 11/182; B42F 17/32; B42F 17/30
See application file for complete search history.

(56) References Cited

U.S. PATENT DOCUMENTS 4,852,727 A * 8/1989 Oberle ..... A45C 11/182 206/39.4
5,125,505 A 6/1992 Kurosaki
(Continued)

FOREIGN PATENT DOCUMENTS

CH 702919 B1 10/2011
CN 204169237 U 2/2015
(Continued)

*Primary Examiner* — Tri M Mai
(74) *Attorney, Agent, or Firm* — Vidas Arrett & Steinkraus P.A.

(57) ABSTRACT

Card holder for bank cards, credit cards, debit cards, driving licences, electronic identity cards or similar cards, having a cuboidal housing with an interior for receiving at least one card, a card opening of the housing for inserting at least one card into the housing and pushing out at least one card from the housing, at least one dispensing element which is displaceable from a first position into a second position in order to be brought into engagement with the lower edge of a card in the interior and to push out the one card through the card opening from the housing, an actuating element which is coupled to the dispensing element in order to displace the dispensing element from the first position into the second position by actuating the actuating element, wherein a first spring apparatus is supported, on the one hand, on the dispensing element and, on the other hand, on the housing, wherein the first spring apparatus is able to be tensioned by displacing the dispensing element from the second position into the first position, a locking apparatus has a first locking element connected to the dispensing element and a second locking element retained in the housing so that the first and second locking elements are able to be locked together by displacing the dispensing element into the first position, and the actuating element is coupled to the locking apparatus in order to unlock the first and second locking elements by actuating the actuating element, so that the first spring apparatus displaces the dispensing element from the first position into the second position in order to push out the card thereby from the card opening.

14 Claims, 11 Drawing Sheets

(56) References Cited

U.S. PATENT DOCUMENTS

| | | | | |
|---|---|---|---|---|
| 9,339,094 | B2 * | 5/2016 | Tucker-Skow ..... | A45C 11/182 |
| 2016/0028186 | A1 * | 1/2016 | He ..... | H04M 1/0256<br>439/159 |

FOREIGN PATENT DOCUMENTS

| | | | |
|---|---|---|---|
| EP | 0286713 | A2 | 10/1988 |
| EP | 0287532 | A2 | 10/1988 |
| EP | 2434922 | B1 | 11/2016 |
| KR | 20-0478130 | | 1/2015 |
| WO | 2010/137975 | A2 | 12/2010 |

* cited by examiner

VIII (5:1)

IX(5:1)

CARD HOLDER FOR CREDIT CARDS AND OTHER CARDS

The invention relates to a card holder for credit cards or other cards.

EP 0 287 532 A2, the entire contents of which is hereby incorporated by reference, discloses a card holder which comprises a cuboidal housing with an open upper face, a cover and an interior dimensioned for receiving a stack of credit cards. The card holder has on the base of the housing a dispensing apparatus which is able to be actuated by hand from the outer face for partially pushing out individual cards to different degrees from the open upper face. The dispensing apparatus comprises a pivoting arm which is pivotable about an axis perpendicular to the main sides of the housing and on one side has a sequence of steps corresponding to the number of cards arranged in the housing. The steps have projections at different spacings from the axis of articulation and each projection thereof is configured to come into contact with the lower edge of a single card. A manually actuatable actuating element on the outer face of the housing is integrally connected to the pivoting arm and pivotable therewith. The actuating element is a pin which protrudes outwardly from a flat side of the pivoting arm relative to the side comprising the steps and through a circular arc-shaped slot in a main side of the housing in order to actuate the pivoting arm from outside. Additionally, the card holder has retaining means on the inside on two narrow sides, said retaining means being configured to come into contact with the side edges of the cards in order to secure these cards and to prevent the cards from inadvertently escaping from the housing. In one embodiment, the retaining means are resiliently deformable strips with inwardly protruding bulged portions.

EP 2 434 922 B1, the entire contents of which is hereby incorporated by reference, discloses a further card holder in which the dispensing apparatus has a two-arm lever which is pivotable about an axis oriented perpendicular to the main sides of the housing, wherein an arm arranged in the housing has dispensing elements arranged in a step-like manner and the other arm is an actuating element protruding from the base of the housing in order to actuate the dispensing apparatus from outside. In a further embodiment, the dispensing apparatus has a U-shaped body with a limb which is arranged in the housing and which comprises steps for successively pushing out the cards from the housing, a limb which is arranged outside the housing and which forms an actuating element which is able to be operated from outside, and a base which connects the two limbs and which is guided outwardly through a slot in the vicinity of the base in a narrow side of the housing. The dispensing apparatus is automatically returned into the initial retracted position by a restoring spring, so that after the selection of all cards the user is able to push back the remaining cards unimpededly. In this card holder the friction element is designed as felt which is made of fibers, for example of metal.

A drawback with the known card holders is that the actuating elements are disadvantageously positioned, whereby a retention of the housing and the simultaneous actuation of the actuating element using only one hand is made more difficult. Moreover, the pivoting arms have long actuating paths. A single-handed operation might, however, be advantageous in order to remove one of the pushed-out cards and to push back the remaining cards using the other hand. In the retaining means of conventional card holders, in an embodiment as a resilient strip, it is a drawback that said retaining means are not able to correctly retain a plurality of cards of a stack of cards which have slightly different dimensions due to manufacturing tolerances or, when designed as felt, have insufficient resilience and reduced clamping action over time.

Proceeding therefrom, the object of the invention is to to provide a card holder for bank cards, credit cards, debit cards, driving licenses, electronic identity cards or similar cards, which has more advantageous handling properties.

The card holder according to the invention for bank cards, credit cards, debit cards, driving licenses, electronic identity cards or similar cards comprises:

- a cuboidal housing with an interior for receiving at least one card,
- a card opening of the housing for inserting at least one card into the housing and pushing out at least one card from the housing,
- at least one dispensing element which is displaceable from a first position into a second position in order to be brought into engagement with the lower edge of a card in the interior and to push out the card through the card opening from the housing,
- an actuating element which is coupled to the dispensing element in order to displace the dispensing element from the first position into the second position by actuating the actuating element, characterized in that

- a first spring apparatus is supported, on the one hand, on the dispensing element and, on the other hand, on the housing, wherein the first spring apparatus is able to be tensioned by displacing the dispensing element from the second position into the first position,
- a locking apparatus which has a first locking element connected to the dispensing element and a second locking element connected to the housing so that the two locking elements are able to be locked together by displacing the dispensing elements into the first position, and
- the actuating element is coupled to the locking apparatus in order to unlock the first and second locking elements by actuating the actuating element, whereby the first spring apparatus displaces the dispensing element from the first position into the second position in order to thereby push out the card from the card opening.

In the card holder according to the invention, the first spring apparatus is tensioned by displacing at least one dispensing element from the second position into the first position. According to a preferred embodiment, the dispensing element is configured such that the tensioning takes place by inserting at least one card into the housing. Alternatively, an additional tensioning apparatus is present for tensioning the first spring apparatus. This tensioning apparatus is located, for example, in a tensioning knob which is connected to the dispensing element and protrudes from the housing through a slotted through-passage, so that it is able to be actuated from outside in order to tension the first spring apparatus by displacing the dispensing element from the second position into the first position. For pushing out a card, the user merely has to actuate the actuating element. As a result, the locking apparatus which locks the first spring apparatus in the pretensioned position is unlocked. By releasing the locking, at least one dispensing element is displaced by the first spring apparatus from the first into the second position and at least one card is pushed out of the card opening of the housing until it protrudes from the housing. The energy stored by tensioning the first spring apparatus is thus used for pushing out at least one card from the housing. In this case the first spring apparatus is partially or entirely released.

Since only the locking apparatus has to be unlocked for pushing out at least one card, so that the first spring apparatus pushes out the cards from the housing, the actuating element may be positioned at an advantageous position of the housing and have a short actuating path. This is particularly advantageous for card holders which facilitate single-handed operation.

According to a preferred embodiment, the actuating element is arranged in the vicinity of the card opening so that the housing may be held in one hand and the actuating element comfortably operated with the thumb of the same hand in order to dispense at least one card. According to a preferred embodiment, the actuating element is arranged on a narrow side of the housing. A right-handed person may hold the card holder in the right hand in order to be able to actuate comfortably the operating element with the right thumb. A left-handed person may hold the card holder rotated by 180° with the left hand so that the left thumb comfortably reaches the actuating apparatus. The respective other hand is available for selecting or, respectively, removing a pushed-out card and optionally for inserting one or more cards which have not been removed. As a result, the handling of the card holder is simplified. Also included in the invention, however, are embodiments in which the actuating element is arranged at a different position.

A further advantage of the card holder is that by using the locking of the locking apparatus the user feels that the card is or, respectively, the cards are correctly inserted. Thus the user may be sure that the card is or, respectively, the cards are inserted as intended into the card holder.

According to a preferred embodiment, a plurality of dispensing elements are displaceable from a first position into a second position in order to be brought into engagement with lower edges of different cards in a stack in the interior and to push out the cards through the card opening from the housing so that they protrude from the housing in a staggered arrangement one behind the other. By means of the plurality of dispensing elements, the cards are pushed out from the housing such that in each case they protrude partially from the housing to a different extent. As a result, selecting individual cards from the stack is simplified, the cards then being able to be pulled entirely out of the housing. Unselected cards may be pushed back again by the user into the housing.

According to a further preferred embodiment, the at least one dispensing element is configured so that the first spring apparatus is able to be pretensioned by displacing the at least one dispensing element from the second position into the first position by at least one card being inserted through the card opening into the housing and pressing with the lower edge against a dispensing element. In this embodiment, the first spring apparatus may be tensioned by inserting the card.

According to a further embodiment, the actuating element is a push button or a slide button. The actuation takes place by a simple translatory movement and does not require any pivoting movement. As a result, the unlocking is further simplified.

According to a further embodiment of the invention, the card holder has a dispensing lever which at one end is pivotably mounted in the housing about an axis and on one side has at least one dispensing element configured in a step-like manner. If the dispensing lever has only one dispensing element, it is able to push out one card or all cards of a stack equally from the housing. According to a preferred embodiment, the dispensing lever has on one side a plurality of dispensing elements which are configured in a step-like manner at different spacings from the axis. By means of this dispensing lever the cards of a stack may be pushed out to different degrees from the housing.

According to a further embodiment, the dispensing lever is pivotably mounted at one end about an axis perpendicular to the two main sides of the housing. According to a further embodiment, the dispensing lever is pivotably mounted about an axis on one side of the housing relative to the card opening. According to a further embodiment, the dispensing lever is pivotably mounted about an axis on the inside on a narrow side of the housing. According to a further embodiment, the dispensing lever is pivotably mounted about an axis on the inside on a short narrow side of the housing.

According to a further embodiment, the dispensing lever in the first position is aligned parallel to the card opening and in the second position is inclined relative to the card opening or aligned perpendicular thereto. According to a further embodiment, the card opening is arranged in a short narrow side of the housing and the dispensing lever in the first position is arranged on the inside on a short narrow side of the housing opposing the card opening.

According to an advantageous embodiment, the card holder is configured to receive cards according to the international standard ISO/IEC 7810 ID-1, preferably with a wall thickness and radii according to ISO/IEC 7813. According to a further embodiment, the card holder is configured to receive cards with a contactless chip or, respectively, contact-carrying chips according to ISO/IEC 7816. The cards may have different functions, for example bank cards (for example credit cards, or electronic payment cards) driving licenses, identity cards, membership cards, discount cards (for example a railcard), premium credit cards (for example Miles & More Card), visiting cards, etc.

According to a further embodiment, the dispensing apparatus comprises the at least one dispensing element on at least one linear carrier component, for example on a dispensing strip, which for the purpose of pushing out cards from the card opening is able to be displaced toward said card opening. According to a further embodiment, the dispensing strip has at least one step-like dispensing element arranged on one side.

According to a further embodiment, the first spring apparatus is a leg spring (also called a "compression spring") or a leaf spring which is supported by a first spring end on the dispensing element and by a second spring end on the housing. A leg spring or leaf spring are particularly space-saving embodiments of the first spring apparatus which permit correspondingly long spring paths for the displacement of the dispensing lever from the first position into the second position. Moreover, they are simple and cost-effective.

According to a further embodiment, the locking apparatus comprises a first locking element in the form of a hook on the dispensing element and a second locking element in the form of a locking edge on the housing. As a result, the locking and unlocking may be implemented in a particularly simple and functionally reliable manner.

According to a further embodiment, the dispensing lever comprises on a side opposite the dispensing element a flat sliding surface which is guided on the inside on a main side of the housing. As a result, a displacement of the dispensing lever in the housing may be achieved with low friction. For the same reasons, on one side relative to the dispensing element a dispensing strip may have a flat sliding surface which is guided on the inside on a main side of the housing.

The second locking element may be connected both indirectly and directly to the housing. According to a further embodiment, the actuating element is coupled to a slide which is arranged in the housing and which is guided by a guide apparatus in the housing in a direction intersecting with or, respectively, traversing the direction of insertion of the cards and on which the second locking element is configured. In this embodiment, by actuating the actuating element the slide is able to be displaced in order to release the locking of the first and the second locking element. According to a further embodiment, the slide is guided by the guide apparatus in the housing in a direction which intersects perpendicular to the direction of insertion of the cards. As a result, a particularly secure locking is effected. Via the slide and the guide apparatus, the second locking element is indirectly connected to the housing. A resilient hook protruding on the inside from one side of the housing, for example from the base, is an embodiment of a second locking element connected directly to the housing.

According to a further embodiment, the guide apparatus has at least one first guide element on the slide and at least one second guide element on the housing. According to a further embodiment, the guide elements are a rib-shaped projection of the slide and a guide slot of the housing or a rib-shaped projection of the housing and a guide slot of the slide.

According to a further embodiment, a second spring apparatus is supported, on the one hand, on the slide and, on the other hand, on the housing in order to pretension the slide with the second locking element in a position locking the first locking element. If the first locking element strikes the second locking element when displacing the dispensing lever into the first position, the second locking element flexes laterally counter to the action of the second spring apparatus. As soon as the first locking element reaches a position in which it is able to be locked to the second locking element, the slide is displaced back by the pretensioned second spring apparatus so that the locking is implemented. Moreover, the locking is able to be easily released by actuating the actuating element and displacing the slide counter to the action of the second spring apparatus. After releasing the actuating element, the second spring apparatus displaces the slide back into its initial position. According to a further embodiment, the second spring apparatus is a helical spring.

According to a further embodiment, the actuating element is coupled to the slide via a wedge gear, gear train, friction gear, belt and chain drive, coupling gear or other gear. The gear permits, in particular, a deflection of the directions of movement and/or a transmission of force. With a wedge gear it is possible to transmit an unlocking movement to the slide, said unlocking movement being oriented perpendicular to the displacement direction of the slide during locking and unlocking. As a result, the actuating element is able to be positioned so as to be comfortably reached on a narrow side of the housing. According to a further embodiment, the actuating element is connected via a rod, which extends parallel to the insertion direction of the cards, to a first wedge which forms the wedge gear with a second wedge at one end of the slide. According to a further embodiment, the actuating element is connected directly or via a rod to the slide. In this embodiment, the displacement of the actuating element is directly transmitted to the slide.

According to a further embodiment, the actuating element is arranged closer to the card opening than on the side of the housing opposing the card opening. As a result, the actuating element is able to be reached particularly comfortably with the thumb.

According to a further embodiment, in the housing on one or more sides parallel to the insertion direction of the card, a first brake element is arranged at the lower end of the interior and/or a second brake element or guide element is arranged in the middle between the lower and upper end of the interior and/or a third brake element is arranged at the upper end of the interior. By means of the brake elements, at least one card may be inserted fully into the housing and/or prevented from falling out in the position partially pushed out of the housing. Moreover, the brake elements may effect a tolerance compensation if the cards used do not accurately adhere to the specified dimensions. Moreover, the brake elements are able to decelerate the cards when pushed out from the housing, so that the cards are not thrown out of the housing. Instead of the second brake element, a guide element may be present, said guide element guiding at least one card in the insertion direction. The brake elements and/or the guide element additionally prevent the at least one card from being jammed when inserted and when pushed out from the housing.

According to a further embodiment, the housing has on the inner face at least one channel extending in the longitudinal direction and connected via a slot to the interior of the housing, the rod being guided therein and/or the first brake element and/or the second brake element or guide element and/or the third brake element being retained therein. This embodiment permits a particularly simple integration of the rod and/or first brake element and/or second brake element or guide element and/or third brake element into the housing. Moreover, the housing is able to be produced in an advantageous manner. For example, the housing is able to be produced by metal extrusion.

According to a further embodiment, the first brake element and/or the second brake element or guide element are configured integrally with the rod. In this embodiment, the first brake element and/or second brake element or guide element may be retained by the rod in the channel.

Preferably, the actuating element, rod, wedge and first brake element and/or second brake element or guide element are produced integrally from one or more plastics and/or from one or more metals. Preferably, the rod and the first wedge consists of a hard resilient plastics or metal. Further preferably, the actuating element consists of a hard resilient plastics or metal or a soft resilient plastics. Further preferably, the first brake element and/or the second brake element or guide element consist of a soft resilient plastics. The production of this component in one piece from different plastics preferably takes place in a multi-component injection-molding process.

According to a further embodiment, the housing consists of metal (for example aluminum or an aluminum alloy) or a different electrically conductive material. As a result, a shielding of the one or more inserted cards may be achieved relative to the surroundings in order to protect these cards from damage by electromagnetic waves (for example against demagnetization) and/or an RFID/NFC chip integrated in a card (for example a credit card or identity card) from being read.

According to a further embodiment, for example, the actuating element is a push button or slide button arranged in a recess on the outer face of the housing, so that it is able to be actuated from outside by one finger in the recess. This embodiment may be configured without projecting elements and counteracts inadvertent actuation of the actuating element.

According to a further embodiment, the housing in horizontal section is thicker on the two lateral edges of two parallel sides than therebetween and/or the two further parallel sides are rounded. In this embodiment, the housing is particularly stable. Additionally, the housing is advantageously able to be produced by metal extrusion.

According to a further embodiment, a plate-shaped bearing carrier with a bearing eye protrudes from a plate-shaped carrier, a bearing pin which pivotably stores the dispensing lever on a flat side of the bearing carrier being retained in said bearing eye. According to a further embodiment, at a distance from the bearing pin a support pin which is parallel thereto protrudes from the bearing carrier, a leg spring being retained on its lower periphery on said support pin, wherein the first spring end of the leg spring is supported on a first abutment on the lower face of the dispensing lever, wherein the second spring end of the leg spring is supported on a second abutment on the carrier at a distance from the bearing pin. According to a further embodiment, the slide is arranged adjacent to the bearing carrier on the carrier. According to a further embodiment, the bearing carrier has a first guide element and the slide has a second guide element which is guided on the first guide element. According to a further embodiment, the carrier with the slide, the dispensing lever and the leg spring is inserted into the housing through a bottom opening of the housing relative to the card opening, so that the dispensing lever, the slide and the leg spring are arranged inside the housing and the plate-shaped carrier covers the bottom opening. This embodiment is able to be mounted in a particularly simple manner and the carrier at the same time is a base of the housing covering the bottom opening. The housing with the card opening on the one side and the bottom opening on the opposing side is additionally able to be produced in a particularly simple manner by continuous metal extrusion and breaking down the extruded metal profile into parts. The carrier in the inserted position is indirectly or directly connected to the housing, preferably by being clamped and/or engaged and/or bonded therein. According to a further embodiment, the bearing carrier has laterally at least one deformable rib for clamping in the housing.

The invention is described hereinafter with reference to the accompanying drawings of exemplary embodiments of the card holder. In the drawings.

In the present application, the terms "top" and "bottom", "horizontal" and "vertical" refer to an alignment of the card holder with the card opening on the upwardly facing end of the housing, so that cards are able to be inserted through the card opening vertically downwards into the interior of the housing and by the walls of the housing are horizontally prevented from escaping from the interior.

Figure 1:
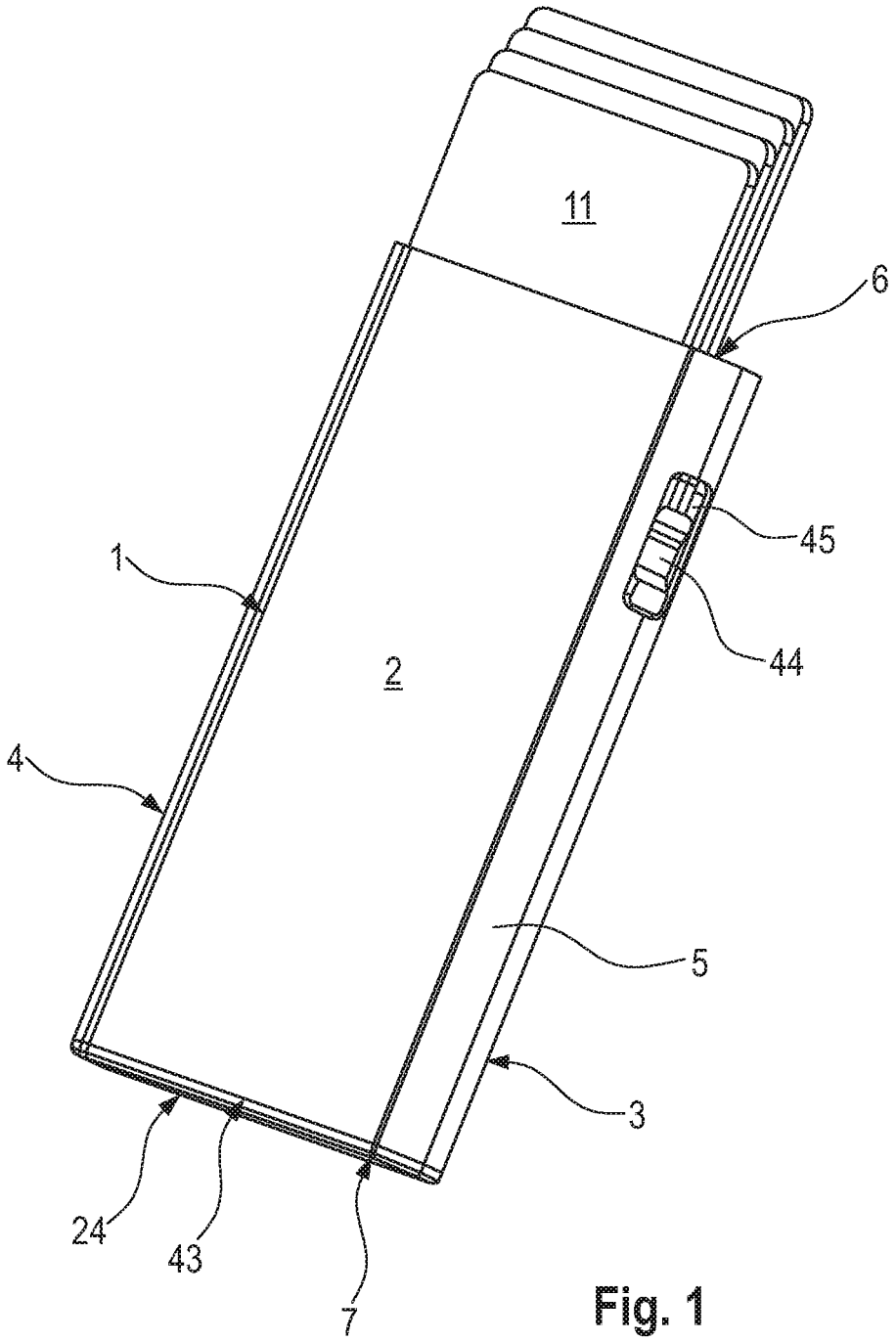
FIG. 1 shows a first exemplary embodiment with partially pushed out cards in a perspective view obliquely from the front and from the side.

According to FIG. 1, the card holder has a cuboidal housing 1. This housing has two large main sides 2, 3, two long narrow sides 4, 5, a card opening 6 on a short narrow side and a base 7 on an opposing short narrow side. The sides 2, 3, 4, 5 are walls of the housing 1.

Figure 2:
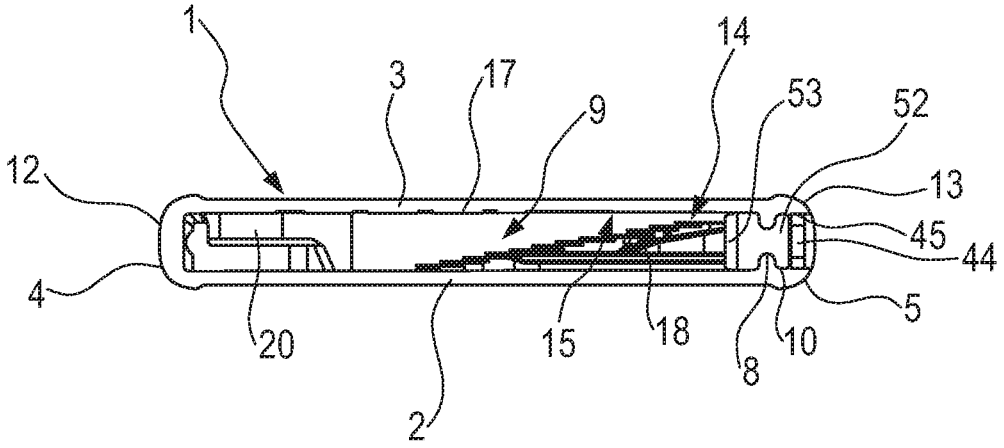
FIG. 2 shows the same card holder without cards in a plan view.
Figure 3:
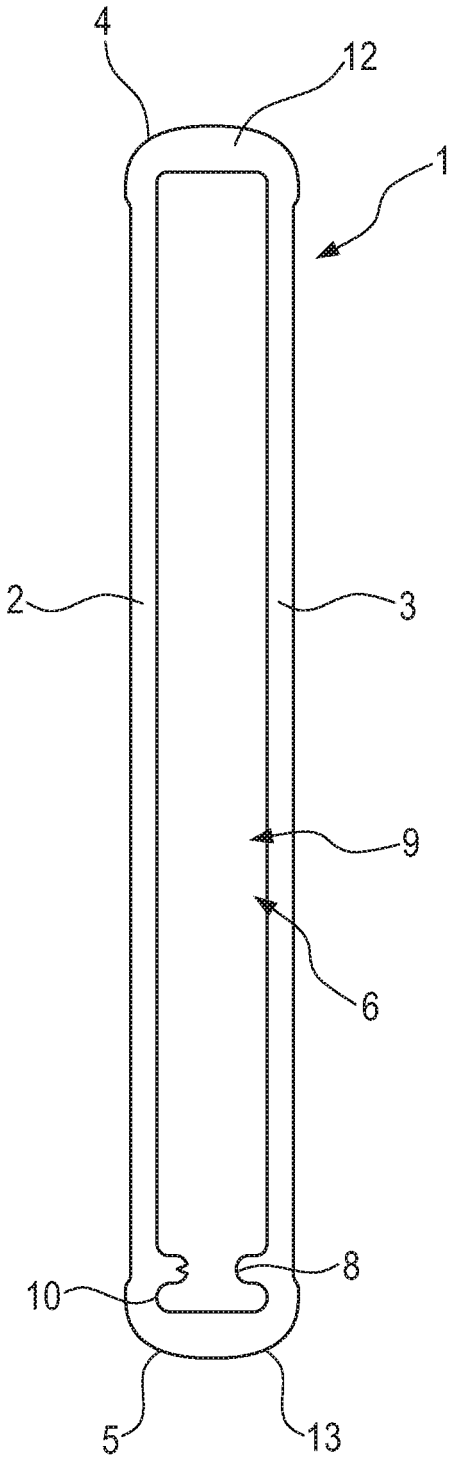
FIG. 3 shows the housing of the same card holder in a plan view.

According to FIGS. 2 and 3, the housing 1 on the long narrow side 5 has a channel 10 which extends in the longitudinal direction and which is connected via a slot to an interior 9 of the housing 1. The housing is provided on both narrow sides 4, 5 to be thicker than on the main sides 2, 3 and with radii 12, 13.

The interior 9 of the housing 1 is dimensioned such that a stack of, for example, five cards 11 according to ISO/IEC 7810 and 7813 or, respectively, 7816 fits exactly. The dimensions of the housing 1 are selected in this case such that the cards 11 fit therein within the context of the permitted manufacturing tolerances with little or no clearance.

According to FIGS. 2 to 5, the card holder has a dispensing apparatus 14 which comprises a dispensing lever 15 which is pivotable about an axis 16. On one side the dispensing lever 15 has a flat sliding surface 17 which bears internally against the main side 3. On the opposing side, the dispensing lever has dispensing elements 18 which are arranged in a step-like manner and which have variable spacings from the axis 16. These dispensing elements have in each case a rounded front edge 19.

The step height of the dispensing elements 18 corresponds to the wall thickness of a card 11 or a fraction thereof. The step height is dimensioned, for example, as described in WO 2010/137975 A2 on page 8, lines 10 to 26, the entire contents of which is hereby incorporated by reference. The spacings between the dispensing elements 18 may, in particular, correspond to those indicated on page 7, lines 27 to 32 of the cited document.

For the pivotable bearing, the dispensing lever 15 has in addition to the step-like dispensing elements 18 a flattened portion 20 from which a bearing pin 21 protrudes.

Moreover, on a lower edge the dispensing lever 15 has a hook-shaped first locking element 22.

The dispensing lever 15 is mounted on a plate-shaped bearing carrier 23 which protrudes upwardly from a plate-shaped carrier 24. The plate-shaped bearing carrier 23 has a bearing eye 25, the bearing pin 21 being pivotably mounted therein.

Figure 4:
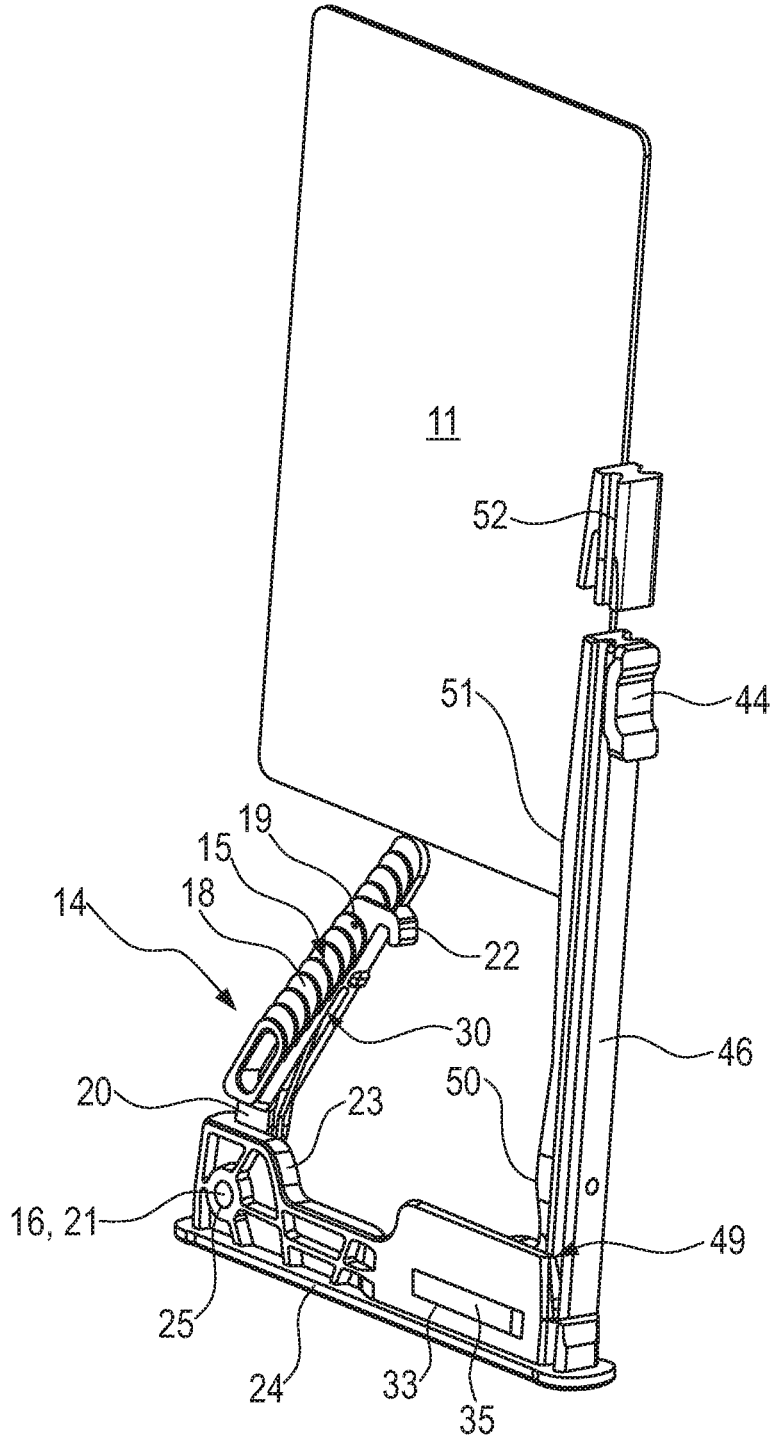
FIG. 4 shows the same card holder without the housing with a partially pushed-out card in a perspective view obliquely from the front and from the side.
Figure 5:
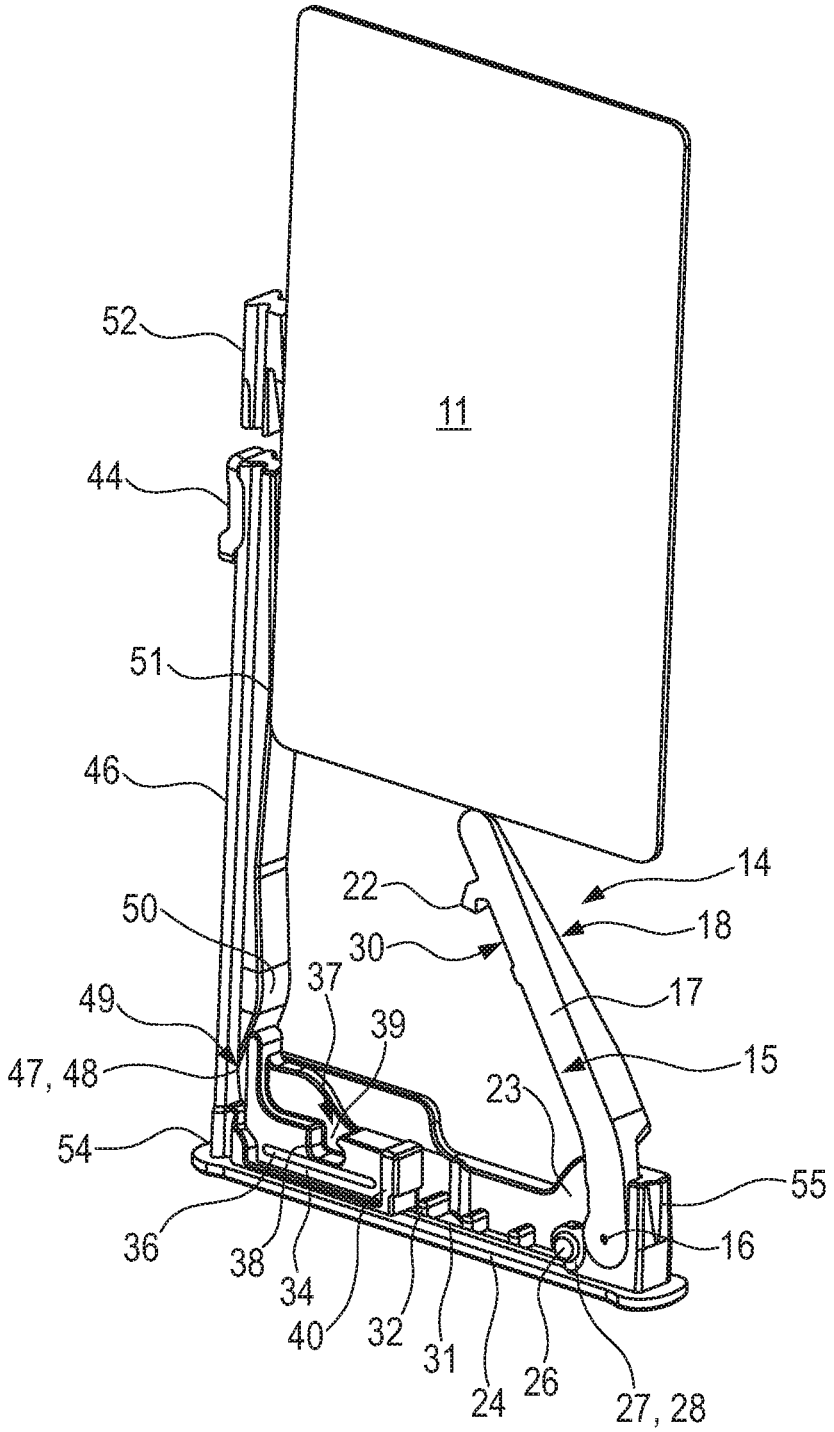
FIG. 5 shows the same card holder without the housing with a partially pushed-out card in a perspective view obliquely from the rear and from the side.
Figure 6:
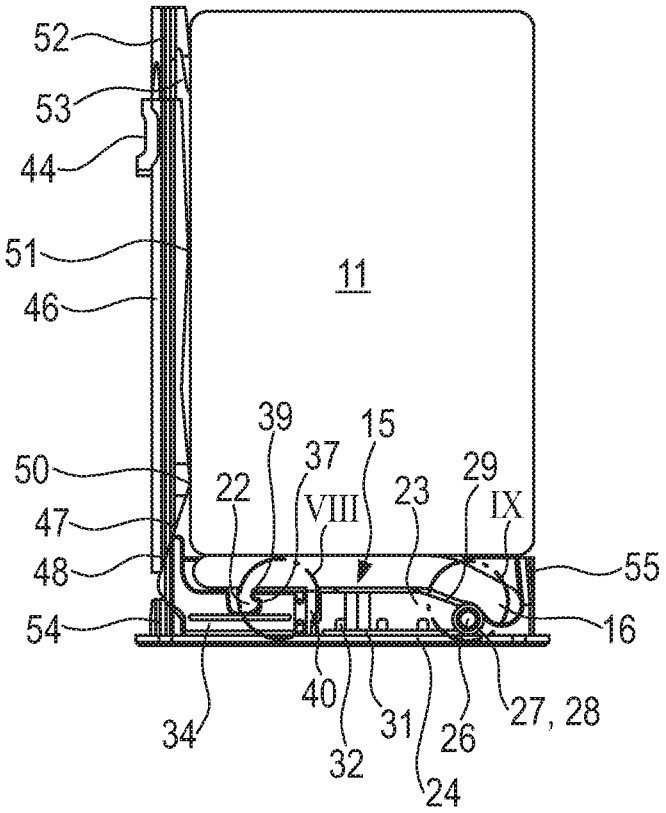
FIG. 6 shows the same card holder without the housing with fully inserted cards in a rear view.
Figure 7:
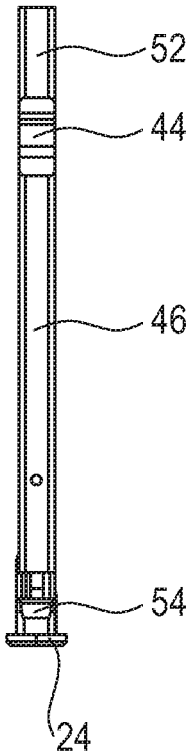
FIG. 7 shows the same card holder without the housing in a view from the right-hand side.

According to FIGS. 5 and 6, a support pin 26 protrudes horizontally from the bearing carrier 23 at a distance from the bearing eye 25. On the support pin 26 a first spring apparatus 27 in the form of a leg spring is guided on its internal periphery 28, the first spring end thereof 29 according to FIG. 4 being retained on either side on first abutments 30 in the form of projections on the lower face of the dispensing lever 15, on a first abutment 30 in the form of a groove 30, and the second spring end 31 thereof being retained on a second abutment 32 in the form of small hooks on the base 24 at a distance from the support pin 26.

In addition, according to FIG. 4, the bearing carrier 23 has on a portion offset to the main side 2 a first guide element 33 in the form of a horizontal guide slot. According to FIG. 5, in addition to the guide slot a slide 34 is displaceably mounted on a flat upper face of the base 24. According to FIG. 4, the slide 34 engages in the guide slot with a second guide element 35 in the form of a rib-shaped projection on a vertical side.

Figure 8:
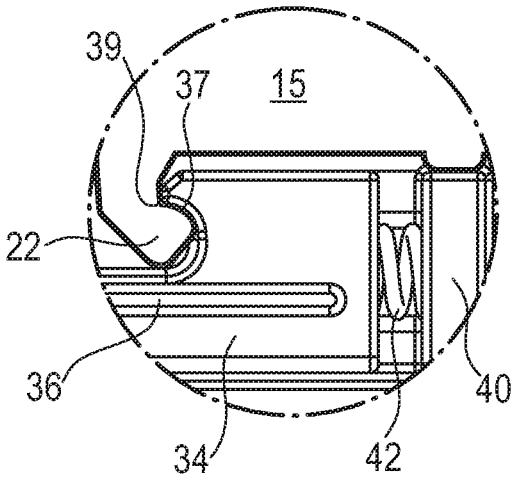
FIG. 8 shows the enlarged detail VII of FIG. 6.
Figure 9:
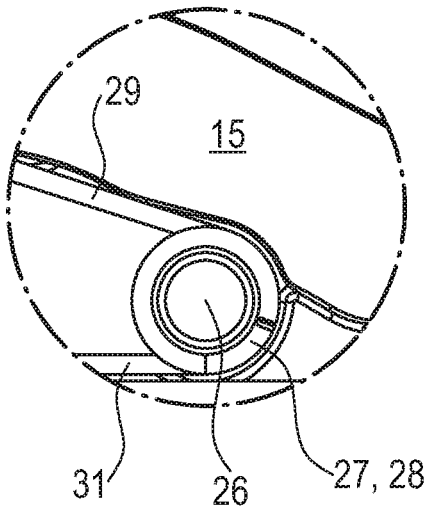
FIG. 9 shows the enlarged detail VIII of FIG. 6.

On an opposing vertical side the slide 34 according to FIG. 5 has a horizontal support rib 36 for support on the inside on the main side 3 of the housing 1. On its upper face, the slide has a second locking element 37 with a receiver 38 and a locking edge 39 which is able to be engaged from behind by the hook-shaped first locking element 22, as shown in FIGS. 6 and 8.

Between the slide 34 and the second abutment 32 a support plate 40 protrudes vertically upwards from the carrier 24. According to FIGS. 10 and 11, the slide 34 on the adjacent side has a blind bore 41, a second spring apparatus 42 in the form of a helical spring being inserted therein, said helical spring being supported, on the one hand, on the internal end of the blind bore 41 and, on the other hand, on the support plate 40.

According to FIG. 1, the carrier 24 terminates the housing 1 on a bottom opening 43 and forms the base 7 of the housing 1.

According to FIGS. 1 and 2, the housing 1 has at the top on a long narrow side 5 an actuating element 44 in the form of a slide button. The slide button is located in a recess 45 on the outer face of the long narrow side 5, so that it is able to be displaced vertically from outside by means of a thumb in the recess 45.

According to FIGS. 4 to 6, the actuating element 44 is connected to a rod 46 which is guided in the channel 12. Preferably, to this end the rod has in horizontal section a double T-profile, as shown in FIG. 4 at the upper end of the rod 46. One T-shaped bar engages in the channel 10, a further T-shaped bar is arranged in the interior 9 and the web connecting the two T-shaped bars penetrates the slot 8. The rod 46 has at the lower end a first wedge 47 which is chamfered downwardly toward the interior 9 in a wedge-shaped manner.

On the side remote from the blind bore 41 the slide 34 has an upwardly protruding second wedge 48 which is chamfered toward the adjacent long narrow side 5 of the housing 1.

The first wedge 47 and the second wedge 48 bear against one another with their chamfered portions and form a wedge gear 49.

The rod 46 on the long side facing the interior 9 has in the vicinity of its lower end adjacent to the wedge 47 a first brake element 50 in the form of a bulged portion oriented toward the interior 9. Approximately in the middle between the base 7 and the card opening 6 the rod 46 has on the long side oriented toward the interior 9 a second brake element or guide element 51 in the form of a bulged portion oriented toward the interior 9. According to FIG. 10, the first brake element 50 and the second brake element or guide element 51 bear against the lateral long edges of the cards 11, when said cards are fully inserted into the housing. As a result, the cards 9 are pressed, guided and decelerated on the inside against the long narrow side 4 of the housing 1 and prevented from falling out.

The first brake element 50 and the second brake element or guide element 51 consist of a resilient material, preferably a soft resilient material.

According to FIGS. 4 and 5, above the rod 46 a third brake element 52 is arranged on the inside on the long narrow side 5 of the housing. The third brake element 52 is according to FIGS. 2 and 4 a body which has in horizontal section a double T-profile. One T-shaped bar is pressed into the channel 10 in the vicinity of the card opening 6, the other T-shaped bar is arranged in the interior 9. The web connecting the two T-shaped bars is passed through the slot 8. The other T-shaped bar is only attached at the top to the web. At the bottom, a gap is present between the web and T-shaped bar so that this gap forms a spring tongue 53.

Figure 10:
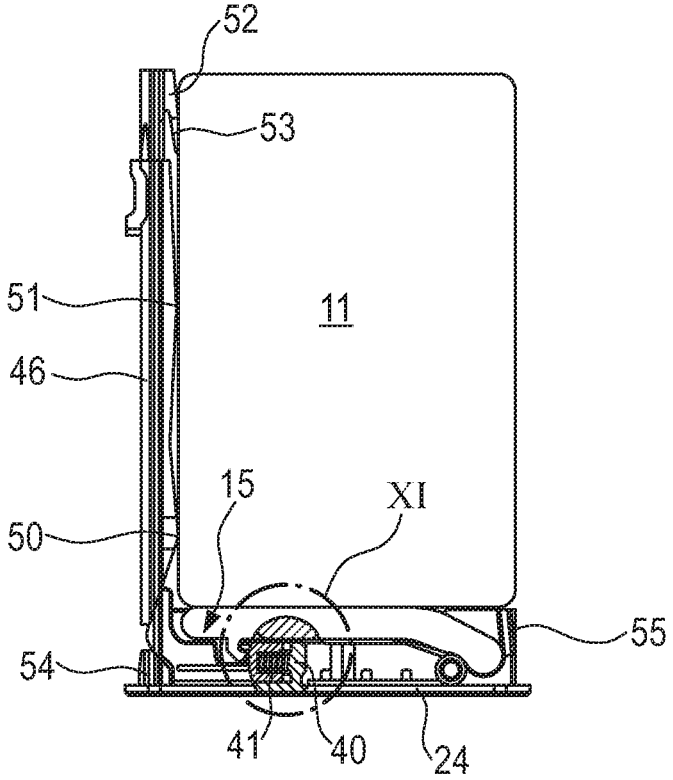
FIG. 10 shows the same card holder without the housing with the partially exploded detail X in a rear view.
Figure 11:
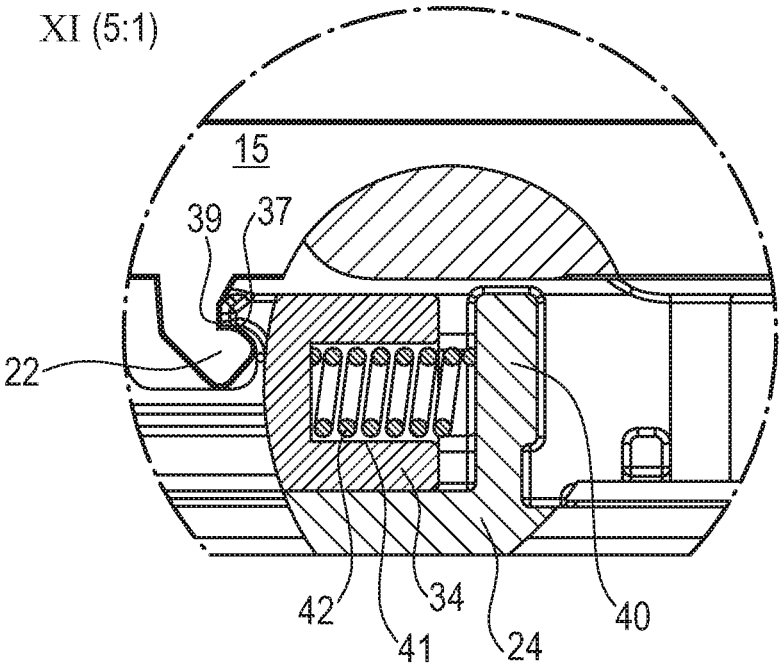
FIG. 11 shows the enlarged detail XI of FIG. 9.

According to FIGS. 6 and 10, the spring tongue 52 bears against the lateral long edges of the cards 11 and presses these cards inwardly against the long narrow side 4 of the housing 1. The third brake element 52 prevents the cards 11 from falling out from the housing 1 when these cards are fully inserted (FIGS. 6 and 10) or are partially pushed out from the housing 1 (FIGS. 1 and 4). In the partially pushed-out position, the cards 11 are additionally hindered from falling out of the housing 1 or guided by the second brake element or guide element 51.

According to FIGS. 5 and 6, the bearing carrier 23 on the two narrow sides has clamping elements 54, 55 in the form of a guide pin (on the left-hand side) and in the form of a deformable rib (on the right-hand side). After inserting the bearing carrier 23 through the bottom opening 43 into the housing 1, the clamping elements 54, 55 securely clamp the bearing carrier 23 in the housing 1.

If no cards 11 are inserted into the housing 1, the dispensing lever 15 is in a position which is inclined obliquely toward the card opening 6, as shown in FIG. 3.

When inserting a card stack, the lower short edges of the cards 11 press against the dispensing elements 18, whereby the dispensing lever 15 is pivoted downwardly. At the same time the leg spring 27 is tensioned. Finally, the first locking element 22 strikes the slide 34 so that this slide is displaced against the action of the helical spring 42. If the first locking element 22 engages in the receiver 38 of the slide 34, the helical spring 42 pushes the slide 34 back, so that the hook-shaped first locking element 22 locks behind the locking edge 39 of the second locking element 37.

For dispensing cards 11, the user pushes the actuating element 44 slightly downwardly. In this case, the first wedge 47 displaces the second wedge 48 counter to the action of the helical spring 42 so that first and second locking elements 22, 37 are unlocked, the leg spring 27 is at least partially released and the dispensing lever 15 pivots in the direction of the card opening 6. In this case, the cards 11 are forced out of the card opening 6 by the dispensing elements 18. Due to the step-like arrangement of the dispensing elements 18, the cards 11 are forced out of the card opening 6 in the fanned-out position as shown in FIG. 1. In this position, the user may select and remove an individual card 11 and push back the remaining cards 11.

When inserting the cards 11 the leg spring 27 is tensioned again.

According to a preferred embodiment, the housing 1 consists of aluminum.

According to a preferred embodiment, one or more of the following elements in each case consist of one or more plastics: dispensing apparatus 14, dispensing lever 15, carrier 24, bearing carrier 23, slide 34, rod 46, actuating element 44, wedge gear 49.

According to a preferred embodiment, the rod 46, the actuating element 44, the wedge 47 and the first and second brake elements 50, 51 are configured integrally. According to a further embodiment, the rod 46 and wedge 47 consist of a hard resilient plastics or metal. According to a further embodiment, the actuating element 44 consists of a hard resilient plastics or a metal or a soft resilient plastics. According to a further embodiment, the first brake element 50 and/or the second brake element or guide element 51 consist of a soft resilient plastics. Preferably, this component is produced from a plurality of different plastics in a multi-component inj ection-molding method.

According to a further embodiment, the third brake element 52 consists of a hard resilient plastics or a soft resilient plastics. According to a further embodiment, the third brake element 52 consists of a hard resilient plastics or a metal and a soft resilient plastics, wherein the spring tongue 53 consists of a soft resilient plastics and moreover, the third brake element 52 consists of a hard resilient plastics or a metal.

According to a preferred embodiment, the first spring apparatus 27 and/or the second spring apparatus 42 consist of a spring steel and/or rubber and/or a soft resilient plastics.

In FIGS. 12 to 15, components of the second and third embodiments which correspond to the components of the first exemplary embodiment are provided with the same reference numerals.

Figure 12:
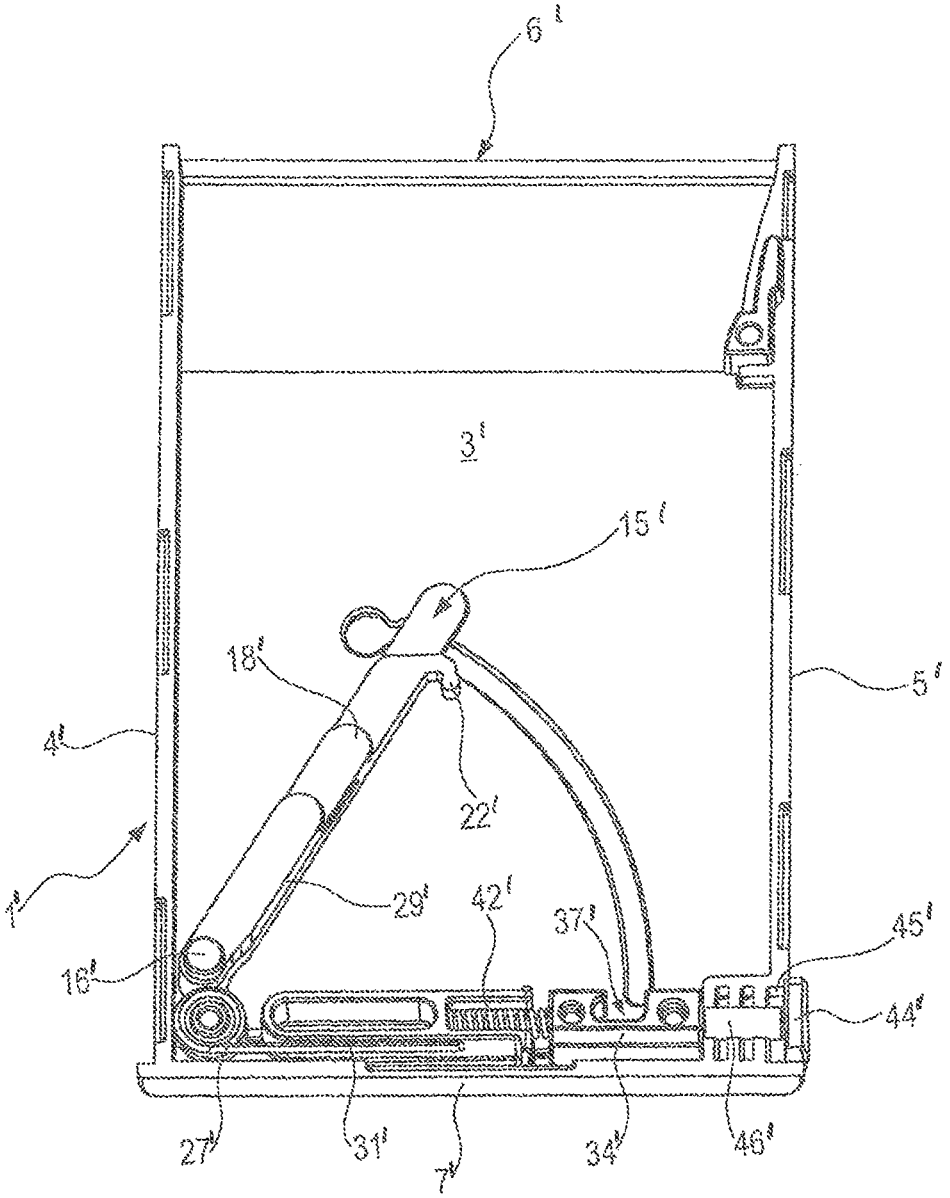
FIG. 12 shows a second embodiment with the dispensing lever unlocked and the cut-away main side of the housing in a perspective view from the front face.
Figure 13:
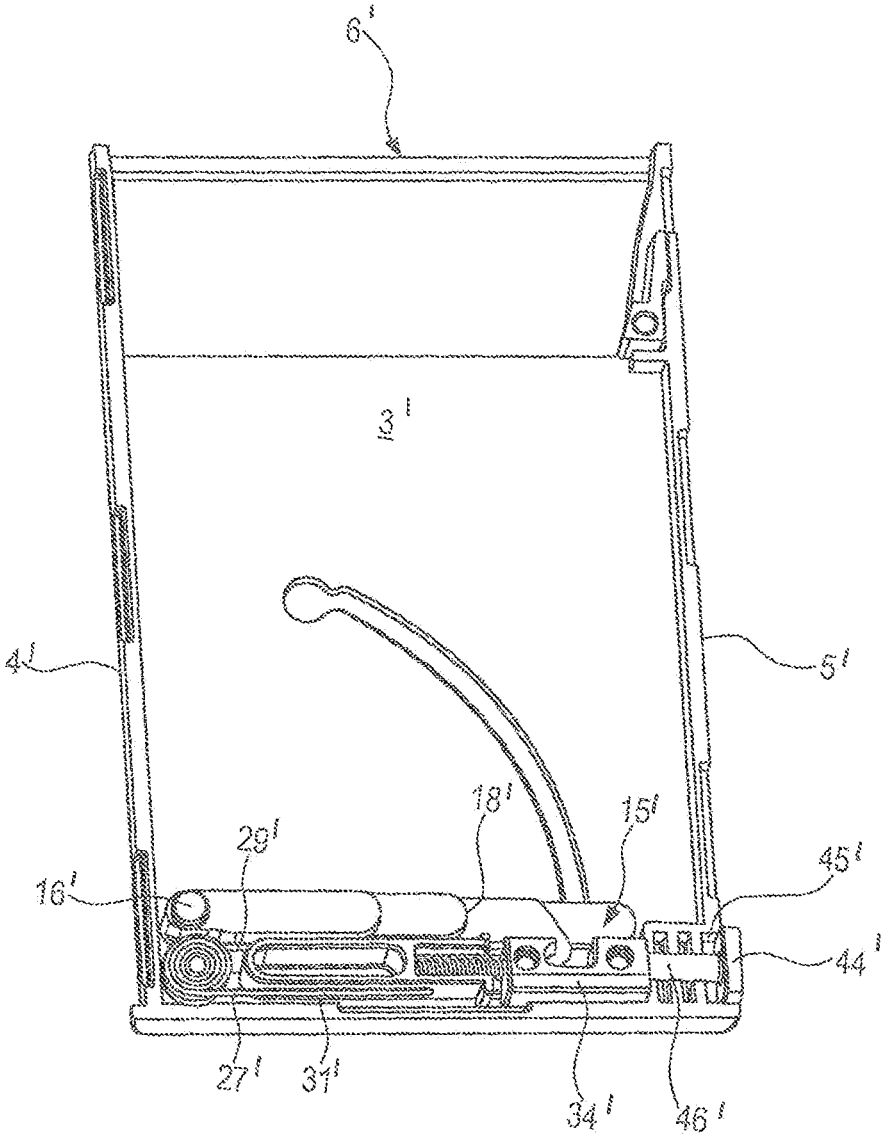
FIG. 13 shows the same card holder with the dispensing lever locked and the cut-away main side of the housing in a perspective view from the front face.

According to FIGS. 12 and 13, in the second exemplary embodiment, an actuating element 44 in the form of a push button is connected to the slide 34 via a horizontal rod 46. The push button is located in a recess 45 on a long narrow side 5 in the vicinity of the lower end of the housing 1. The pretensioning of the first spring apparatus 27 takes place as in the first exemplary embodiment. For dispensing the cards 11 the push button 44 simply has to be pressed.

Figure 14:
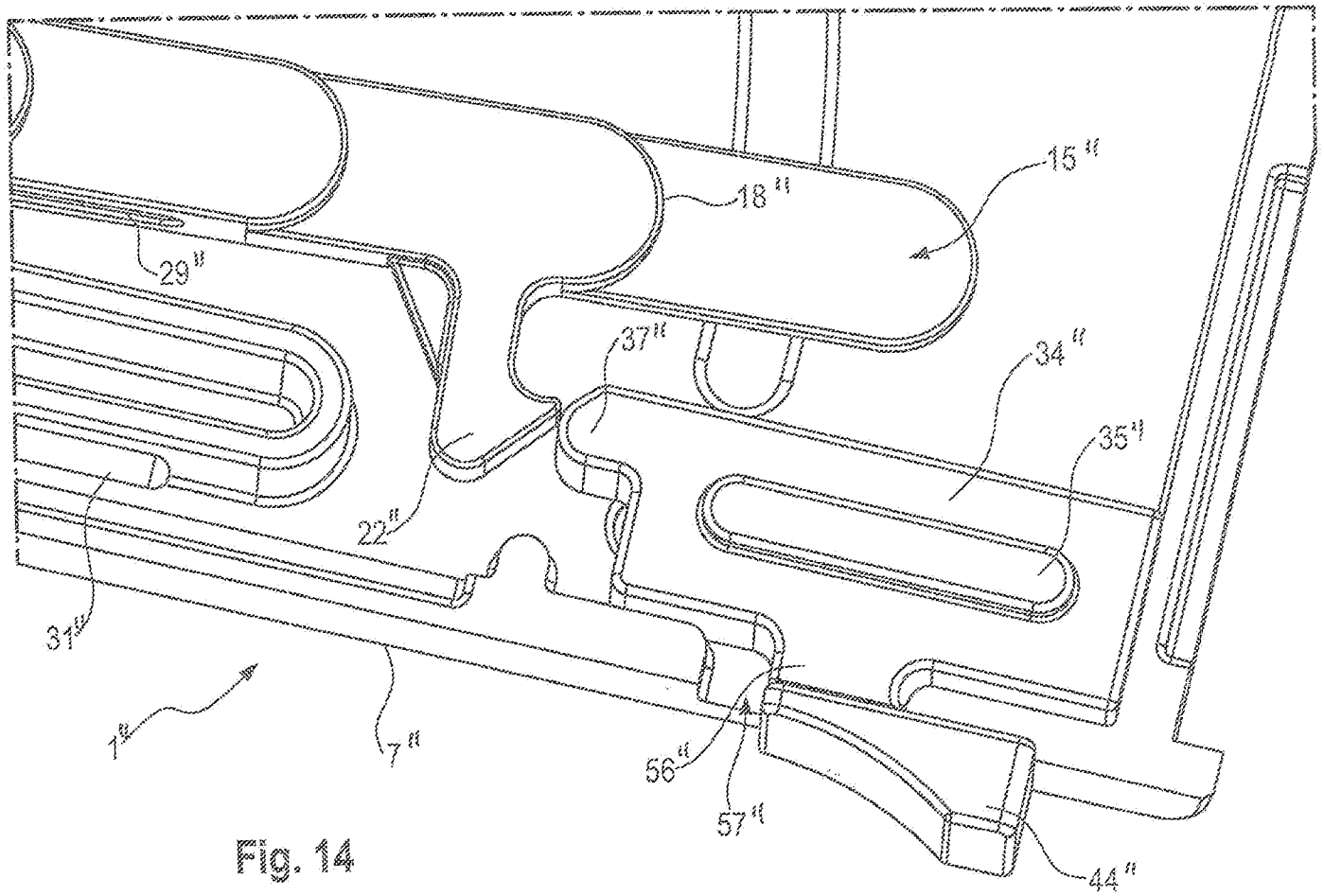
FIG. 14 shows a third exemplary embodiment with the dispensing lever unlocked and the cut-away main side of the housing in a perspective partial view from the front.
Figure 15:
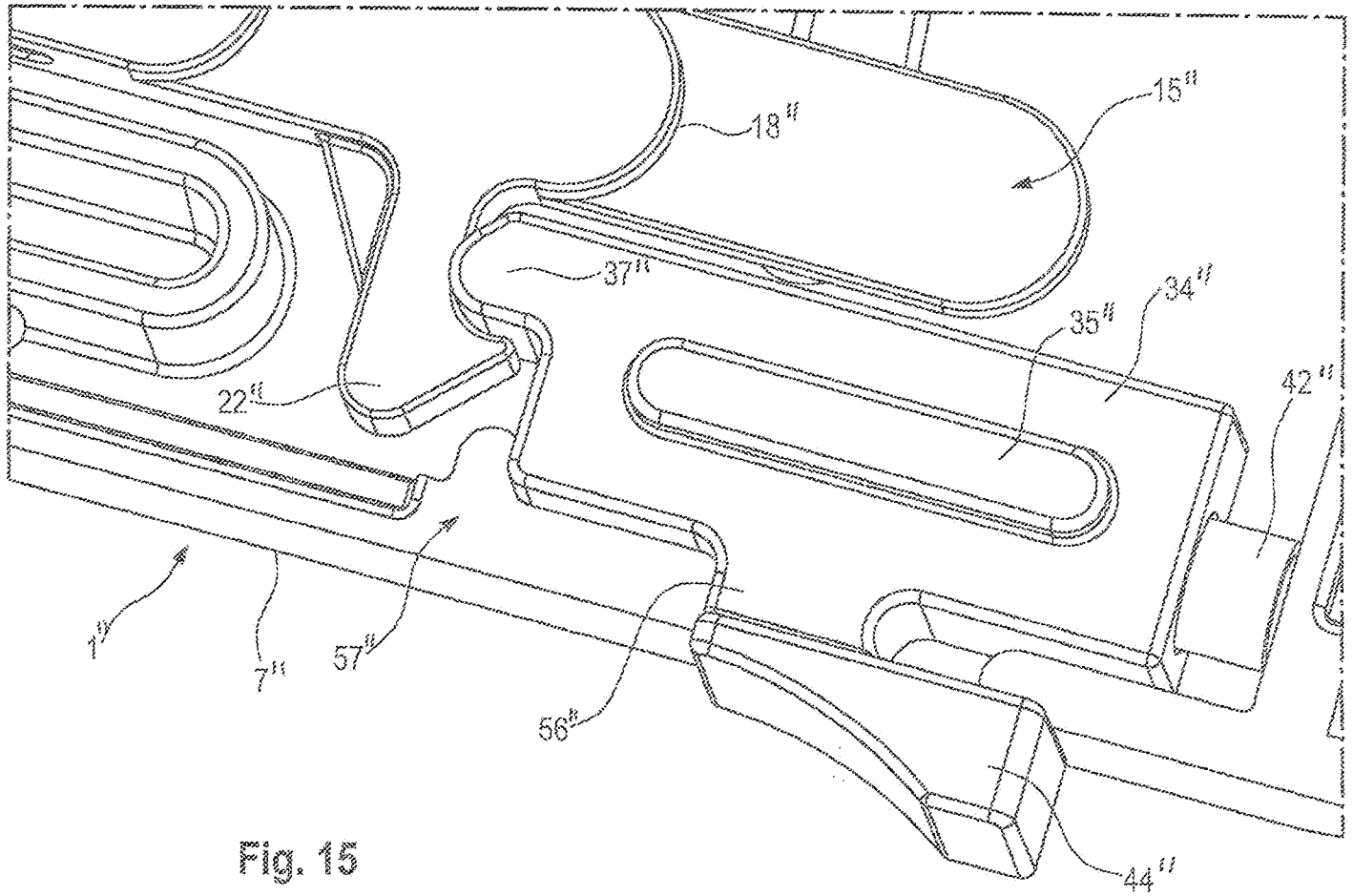
FIG. 15 shows the same card holder with the dispensing lever locked and the cut-away main side of the housing in a perspective partial view from the front.

According to FIGS. 14 and 15, in the third exemplary embodiment, an actuating element 44 in the form of a slide button on the base 7 of the housing 1 relative to the card opening 6 is connected via a vertical connecting web 56 to the slide 34. The connecting web 56 extends through a slotted through-passage 57 in the base 7 of the housing. The pretensioning of the first spring apparatus 27 takes place as in the first exemplary embodiment. For dispensing the cards 11 the slide button 44 simply has to be displaced.

The cut-away parts of the third exemplary embodiment are preferably configured as in the second exemplary embodiment.

LIST OF REFERENCE NUMERALS

1, 1', 1" Housing
2, 3, 2', 3', 2", 3" Main side
4, 5, 4', 5', 4", 5" Long narrow side
6, 6', 6" Card opening
7, 7', 7" Base
8 Slot
9 Interior
10 Channel
11, 11', 11" Card
12, 13 Radius
14 Dispensing apparatus
15, 15', 15" Dispensing lever
16, 16', 16" Axis
17 Sliding surface
18, 18', 18" Dispensing elements
19 Front edge
20 Flattened portion
21 Bearing pin
22, 22', 22" First locking element
23 Bearing carrier
24 Carrier
25 Bearing eye
26 Support pin
27, 27', 27" First spring apparatus
28 Internal periphery
29, 29', 29" First spring end
30 First abutment
31, 31', 31" Second spring end
32 Second abutment
33 First guide element
34, 34', 34" Slide
35 Second guide element
36 Support rib
37, 37', 37" Second locking element
38 Receiver
39 Locking edge
40 Support plate
41 Blind bore
42, 42', 42" Second spring apparatus
43 Bottom opening
44, 44', 44" Actuating element
45, 45', 45" Recess
46, 46', 46" Rod
47 First wedge
48 Second wedge
49 Wedge gear
50 First brake element
51 Second brake element or guide element
52 Third brake element
53 Spring tongue
54 Clamping elements
55 Clamping elements
56, 56', 56" Connecting web
57, 57', 57" Slotted through-passage

The invention claimed is:

1. A card holder for bank cards, credit cards, debit cards, driving licenses, electronic identity cards or similar cards, comprising a cuboidal housing (1) with an interior (9) for receiving at least one card (11), a card opening (6) of the housing (1) for inserting at least one card (11) into the housing and pushing out at least one card (11) from the housing (1), a dispensing lever (15) which at one end is pivotably mounted in the housing (1) about an axis (16) and on one side comprises dispensing elements (18) which are configured in a step-like manner at different spacings from the axis, the dispensing elements (18) being displaceable from a first position into a second position in order to be brought into engagement with the lower edges of cards (11) of a stack of cards inserted in the interior (9) and to push out the cards (11) through the card opening (6) to different degrees from the housing (1), an actuating element (44) which is coupled to the dispensing element (18) in order to displace the dispensing element (18) from the first position into the second position by actuating the actuating element (44), a first spring apparatus (27) being supported, on the one hand, on the dispensing element (18) and, on the other hand, on the housing (1), wherein the first spring apparatus (27) is able to be tensioned by displacing the dispensing element (18) from the second position into the first position, a locking apparatus which locks the first spring apparatus (27) in the first position, and the actuating element (44) is coupled to the locking apparatus in order to unlock the locking apparatus by actuating the actuating element (44), so that the first spring apparatus (27) displaces the dispensing element (18) from the first position into the second position in order to push out the card (11) thereby from the card opening (6).

2. The card holder as claimed in claim 1, wherein a plurality of dispensing elements (18) are able to be displaced from a first position into a second position in order to be brought into engagement with lower edges of different cards (11) in a stack in the interior (9) and to push out the cards (11) through the card opening (6) from the housing (1) so that they protrude from the housing (1) in a staggered arrangement one behind the other.

3. The card holder as claimed in claim 2, comprising one or more of the following features:

(a) a plate-shaped bearing carrier (23) with a bearing eye (25) protrudes from a plate-shaped carrier (24), a bearing pin (21) which pivotably mounts the dispensing lever (15) on a flat side of the bearing carrier (23) being retained in said bearing eye, (b) at a distance from the bearing eye (25) a support pin (26) which is parallel thereto protrudes from the bearing carrier (23), a leg spring (27) being retained on its internal periphery (28) on said support pin, wherein the first spring end (29) of the leg spring (27) is supported on a first abutment (30) on the lower face of the dispensing lever (15), wherein the second spring end (31) of the leg spring (27) is supported on a second abutment (32) on the carrier (24) at a distance from the bearing eye (25), (c) the slide (34) is arranged on the carrier (24), (d) the bearing carrier (23) has a first guide element (33) and the slide (34) has a second guide element (35) which is guided on the first guide element (33), (e) the carrier (24) with the slide (34), the dispensing lever (15) and the leg spring (27) is inserted into the housing (1) through a bottom opening (43) of the housing (1) relative to the card opening (6), so that the dispensing lever (15), the slide (34) and the leg spring (37) are arranged inside the housing (1) and the carrier (24) is a base (7) of the housing (1) covering the bottom opening (43), (f) the carrier (24) in the inserted position is connected to the housing (1) by being clamped and/or engaged and/or bonded therein.

4. The card holder as claimed in claim 1, wherein the at least one dispensing element (18) is configured so that the first spring apparatus (27) is able to be tensioned by displacing the at least one dispensing element (1) from the second position into the first position by at least one card (11) being inserted through the card opening (6) into the housing (1) and pressing with the lower edge against a dispensing element (18).

5. The card holder as claimed in claim 1, wherein the first spring apparatus (27) is a leg spring or a leaf spring which is supported by a first spring end (29) on the dispensing element (18) and by a second spring end (31) on the housing (1).

6. The card holder as claimed in claim 1, wherein the actuating element (44) is coupled to a slide (34) which is displaceably arranged in the housing (1) and which is guided by a guide apparatus (33, 35) in the housing in a direction intersecting with the direction of insertion of the cards (11) and on which the second locking element (37) is configured.

7. The card holder as claimed in claim 6, wherein a second spring apparatus (41) is supported, on the one hand, on the slide (34) and, on the other hand, on the housing (1) in order to pretension the slide (34) with the second locking element (37) in a position locking the first locking element (22).

8. The card holder as claimed in claim 6, wherein the actuating element (44) is coupled to the slide (34) via a wedge gear (49).

9. The card holder as claimed in claim 8, wherein the actuating element (44) is connected via a rod (46), which extends parallel to the insertion direction of the cards (11), to a first wedge (47) which forms the wedge gear (49) with a second wedge (48) on an end of the slide.

10. The card holder as claimed in claim 1, wherein the actuating element (44) is arranged closer to the card opening (6) than on the side of the housing (1) opposing the card opening.

11. The card holder as claimed in claim 1, wherein in the housing (1) on one or more sides parallel to the insertion direction of the card (11) a first brake element (50) is arranged at the lower end of the interior (9) and/or a second brake element or guide element (51) is arranged in the middle between the lower and upper end of the interior (9) and/or a third brake element (52) is arranged at the upper end of the interior (9).

12. The card holder as claimed in claim 1, wherein the housing (1) has on the inner face at least one channel (10) extending in the longitudinal direction and connected via a slot (8) to the interior (9) of the housing (1), the rod (46) being guided therein and/or the first brake element (50) and/or the second brake element or guide element (51) and/or the third brake element (53) being retained therein.

13. The card holder as claimed in claim 1, wherein the actuating element (44) is arranged in a recess (45) outside on the housing (1) so that it is able to be actuated from the outside by one finger.

14. The card holder as claimed in claim 1, wherein the housing (1) in horizontal section is thicker on the two lateral edges of two parallel sides (2, 3) than therebetween and/or the two further parallel sides (4, 5) are rounded.

* * * * *